US005931027A

United States Patent [19]

Shin

[11] Patent Number: 5,931,027

[45] Date of Patent: Aug. 3, 1999

[54] FILTER FOR A WASHING MACHINE

[75] Inventor: Jung-soo Shin, Suwon, Rep. of Korea

[73] Assignee: Samsung Electronics Co., Ltd., Suwon, Rep. of Korea

[21] Appl. No.: 09/028,354

[22] Filed: Feb. 24, 1998

[30] Foreign Application Priority Data

Aug. 16, 1997 [KR] Rep. of Korea ..... 97-39035

[51] Int. Cl.[6] ..... D06F 39/10

[52] U.S. Cl. ..... 68/18 F; 210/136; 210/167; 210/232; 210/485; 210/497.01

[58] Field of Search ..... 68/18 F; 210/136, 210/167, 232, 485, 497.01

[56] References Cited

U.S. PATENT DOCUMENTS 5,509,283 4/1996 Lee et al. ..... 68/18 F

FOREIGN PATENT DOCUMENTS 230394 9/1989 Japan ..... 68/18 F
285595 10/1992 Japan ..... 68/18 F
288 469 10/1996 Taiwan .

*Primary Examiner*—Philip R. Coe
*Attorney, Agent, or Firm*—Burns, Doane, Swecker & Mathis, L.L.P.

[57] ABSTRACT

A filter for a washing machine is disclosed. The filter includes a pocket type filter having a front panel attached with a mesh net to one side thereof for filtering fluff intermingled in the washing water, a rear panel for forming a predetermined space with the front panel by being coupled to the front panel by means of a hinge shaft to be opened/closed while being attached with a mesh net for filtering the fluff intermingled in the washing water to one side thereof, and a check valve fixed to the lower side of the rear panel for confining the flow of the washing water introduced into the space between the front panel and the rear panel, and a filter case attached to an inner lower portion of a dehydrating tub of the washing machine for forming a predetermined space with the dehydrating tub, having an attachment portion for being attached to the dehydrating tub and a filter receiving portion formed with an opening portion to be inserted with the pocket type filter from the preceding side thereof, whereby the front panel of the pocket type filter and the filter case form a frontal shape such as a continuous curved shape. According to the present invention as described above, since the pocket type filter and the filter case form a continuous curved shape when the pocket type filter is secured in the filter receiving portion of the filter case, the frontal shape prevents the laundry from damage during the washing or rinsing cycle.

1 Claim, 7 Drawing Sheets

FILTER FOR A WASHING MACHINE

RELATED INVENTION

This invention is related to inventions disclosed in commonly assigned U.S. Pat. No. 5,858,220 issued Jan. 12, 1999; U.S. Pat. No. 5,863,423 issued Jan. 26, 1999; U.S. application(s) Ser. No. 09/028,526, Ser. No. 09/028,527, and Ser. No. 09/028,668 filed on Feb. 24, 1998, respectively, and U.S. Pat. No. 5,849,182 issued Dec. 15, 1998, the disclosures of which are incorporated by reference herein.

BACKGROUND OF THE INVENTION

1. Field of the Invention

The present invention relates to a washing machine, and more particularly to a filter for a washing machine for filtering foreign matters such as fluff from washing water.

2. Description of the Prior Art

FIG. 1 illustrates a conventional washing machine. Referring to FIG. 1, in the conventional washing machine, a washing tub 120 is suspended by a suspension 130 into inside of a case 110.

A dehydrating tub 170 and a pulsator (or an agitator; hereinafter refer to "a pulsator") 180 selectively driven by a clutch assembly 160 which is connected to a motor 150 by means of a belt 140, are disposed in the inner side of washing tub 120.

An impeller 182 as a pump is integrally formed to the lower side of pulsator 180, and a filter 190 is provided around the upper end of dehydrating tub 170. A guide portion 172 for guiding the washing water pumped by impeller 182 toward filter 190 is formed between impeller 182 and filter 190.

In the washing machine constructed as above, once pulsator 180 is rotated by motor 150 and clutch assembly 160 during a washing or rinsing cycle, the washing water pumped by impeller 182 at the lower portion of pulsator 180 is guided to filter 190 along guide portion 172 to be dropped into the interior of dehydrating tub 170 via filter 190. During this process, foreign matters intermingled in the washing water are filtered by filter 190.

However, according to the conventional washing machine constructed as above, filter 190 is arranged around the upper end of dehydrating tub 170. For this reason, when a small amount of articles is washed in a small quantity of cleaning water, the washing water cannot reach filter 190. That is, the foreign matters intermingled in the washing water cannot be sufficiently filtered by filter 190 to lower washing efficiency.

FIGS. 2 to 4B show another filter for a washing machine proposed to overcome the above described problems as a example.

As illustrated, the filter for a washing machine is attached to the inner lower portion of dehydrating tub 170, which includes a filter case 300 and a pocket type filter 200 for filtering fluff by being inserted into filter case 300.

Filter case 300 is attached to the inner lower portion of dehydrating tub 170 to form a predetermined space with dehydrating tub 170, which includes an attachment portion 310 for attaching itself onto dehydrating tub 170, a front plane portion 320 formed with a plurality of discharging holes 322 and inserting guide portions 330 formed to both rear sides of front plane portion 320 while having the upper portion opened.

Pocket type filter 200 includes a front panel 210, a rear panel 230 and a check valve 250. Front panel 210 and rear panel 230 are coupled to be opened/closed by a hinge shaft 232 formed to rear panel 230, and attached with mesh nets 220 and 240 for filtering the fluff. Check valve 250, for opening/closing the space between front panel 210 and rear panel 230, is fixed to the lower side of rear panel 230 and made of a material such as a rubber.

Pocket type filter 200 as described above is inserted into the interior of the space between filter case 300 and dehydrating tub 170 by being slidably moved along inserting guide portions 330 from the upper portion of inserting guide portions 330 of filter case 300.

According to the filter as described above, the washing water pumped by impeller 182 flows into pocket type filter 200 via the space between dehydrating tub 170 and filter case 300 during the washing or rinsing cycle. Check valve 250 is upwardly pushed away by means of the washing water thereby the washing water is introduced into the interior of pocket type filter 200.

The washing water introduced into inside of pocket type filter 200 is discharged into 10 dehydrating tub 170 via mesh nets 220 and 240 of front panel 210 and rear panel 230. At this time, the fluff within the washing water is filtered by mesh nets 220 and 240 attached to the front panel 210 and rear panel 230. Also, the washing water exhausted out of pocket type filter 200 is discharged into the interior of dehydrating tub 170 via discharging holes 322 formed in front plane portion 320 of filter case 300.

Under the state that the rotation of a pulsator is stopped after completing the washing or rinsing cycle, check valve 250 returns to its original position by means of gravity. Consequently, the filtered fluff is accumulated into the interior of pocket type filter 200 without getting away from pocket type filter 200.

The fluff accumulated on the interior of pocket type filter 200 is closely attached toward rear panel 230 due to a centrifugal force exerting upon the fluff by dehydrating tub 170 which is rotated at high speed during a dehydrating cycle. By doing so, the washing water pumped by impeller 182 can be easily introduced into pocket type filter 200 during the initial period of the next washing or rinsing cycle.

Filter case 300 is attached to the inner lower portion of a dehydrating tub 170 to form a predetermined space with dehydrating tub 170, which includes an attachment portion 310 for attaching itself onto dehydrating tub 170, a front plane portion 320 formed with a plurality of discharging holes 322 and inserting guide portions 330 formed to both rear sides of front plane portion 320 while having the upper portion opened.

However, according to the other filter for a washing machine constructed as described above, since an upper end 210*a* of front panel 210 of pocket type filter 200, as shown in an enlarged portion of FIG. 4, is formed sharp, the laundry flowed within dehydrating tub 170 is often damaged by the upper end 210*a* of front panel 210 during the washing and rinsing cycles.

SUMMARY OF THE INVENTION

Therefore, it is an object of the present invention to provide a filter for a washing machine for filtering foreign matters intermingled in washing water capable of preventing laundry from damage by its own shape.

To achieve the object, the present invention provides a filter for a washing machine comprising a pocket type filter including a front panel attached with a mesh net to one side thereof for filtering fluff intermingled in the washing water, a rear panel for forming a predetermined space with the front panel by being coupled to the front panel by means of a hinge shaft to be opened/closed while being attached with a mesh net for filtering the fluff intermingled in the washing water to one side thereof, and a check valve fixed to the lower side of the rear panel for confining the flow of the washing water introduced into the space between the front panel and the rear panel; and a filter case attached to an inner lower portion of a dehydrating tub of the washing machine for forming a predetermined space with the dehydrating tub, including an attachment portion for being attached to the dehydrating tub and a filter receiving portion formed with an opening portion to be inserted with the pocket type filter from the preceding side thereof; whereby the front panel of the pocket type filter and the filter case form a frontal shape such as a continuous curved shape.

According to the present invention, since the pocket type filter and the filter case form a continuous curved shape when the pocket type filter is accommodated within the filter receiving portion of the filter case, the frontal shape prevents the laundry from damage during the washing or rinsing cycle.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
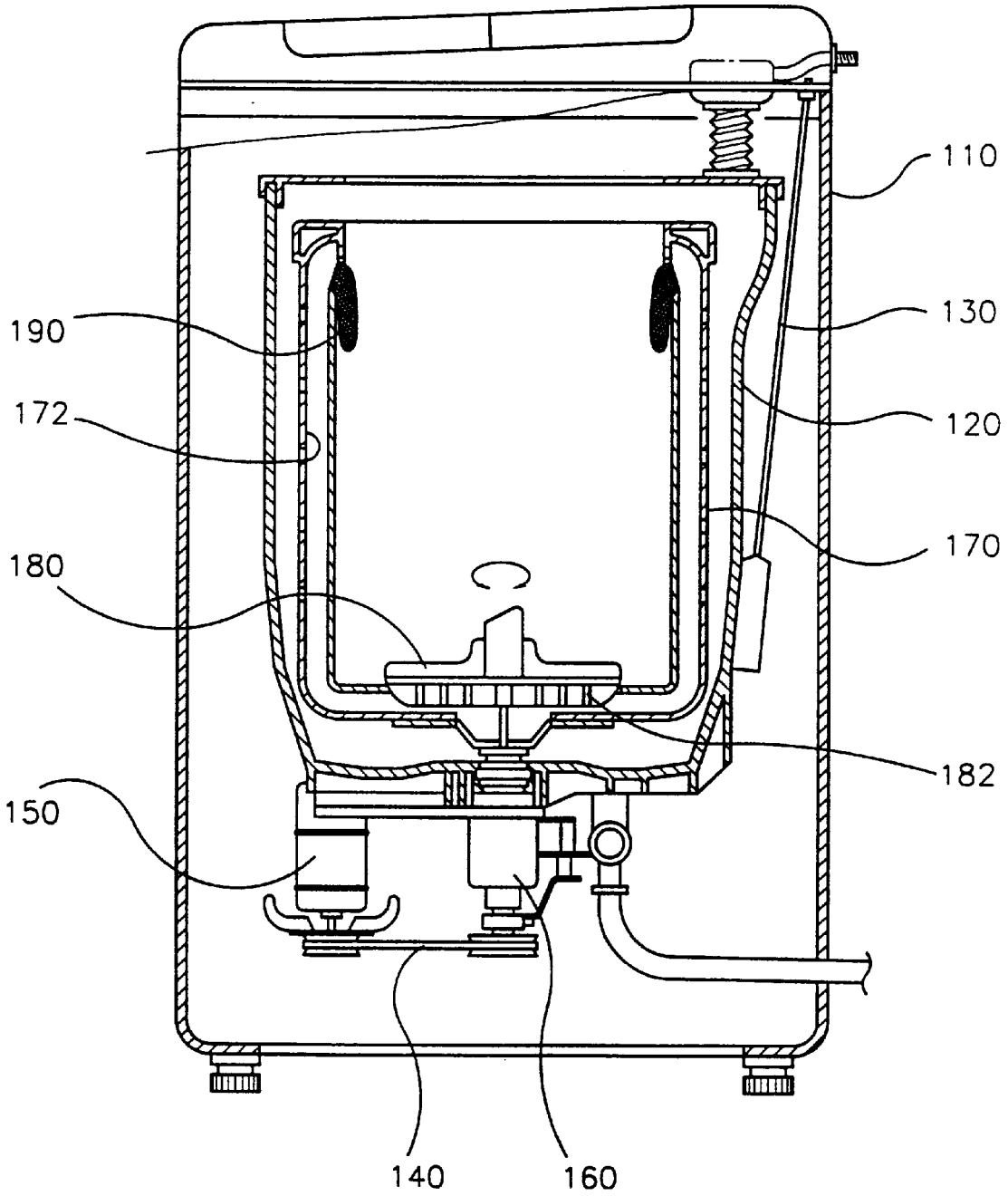
FIG. 1 (PRIOR ART)
FIG. 1 is a sectional view showing a general full automatic washing machine having a filter.
Figure 2:
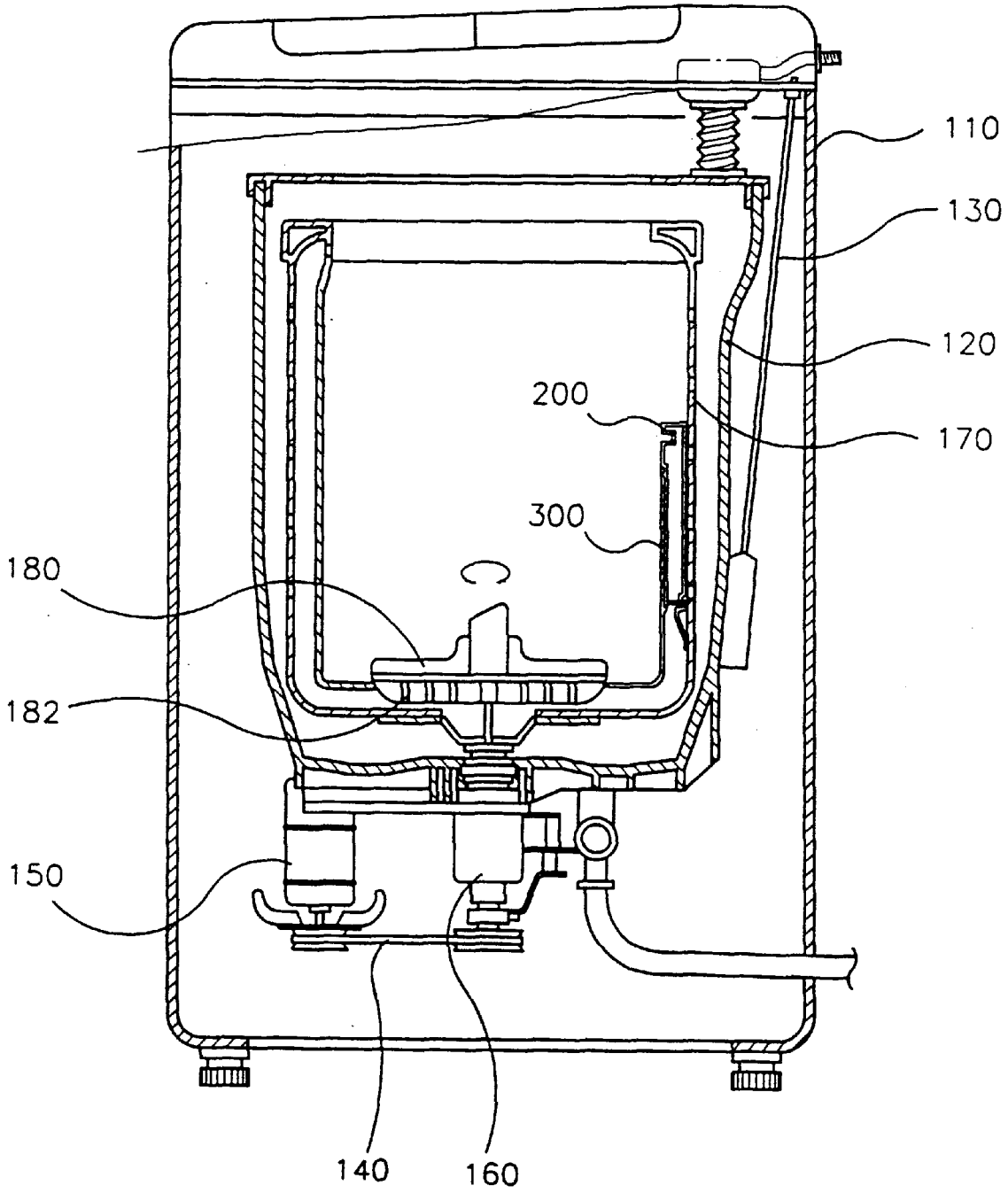
FIG. 2 (PRIOR ART)
FIG. 2 is a sectional view showing other general full automatic washing machine having a filter.
Figure 3:
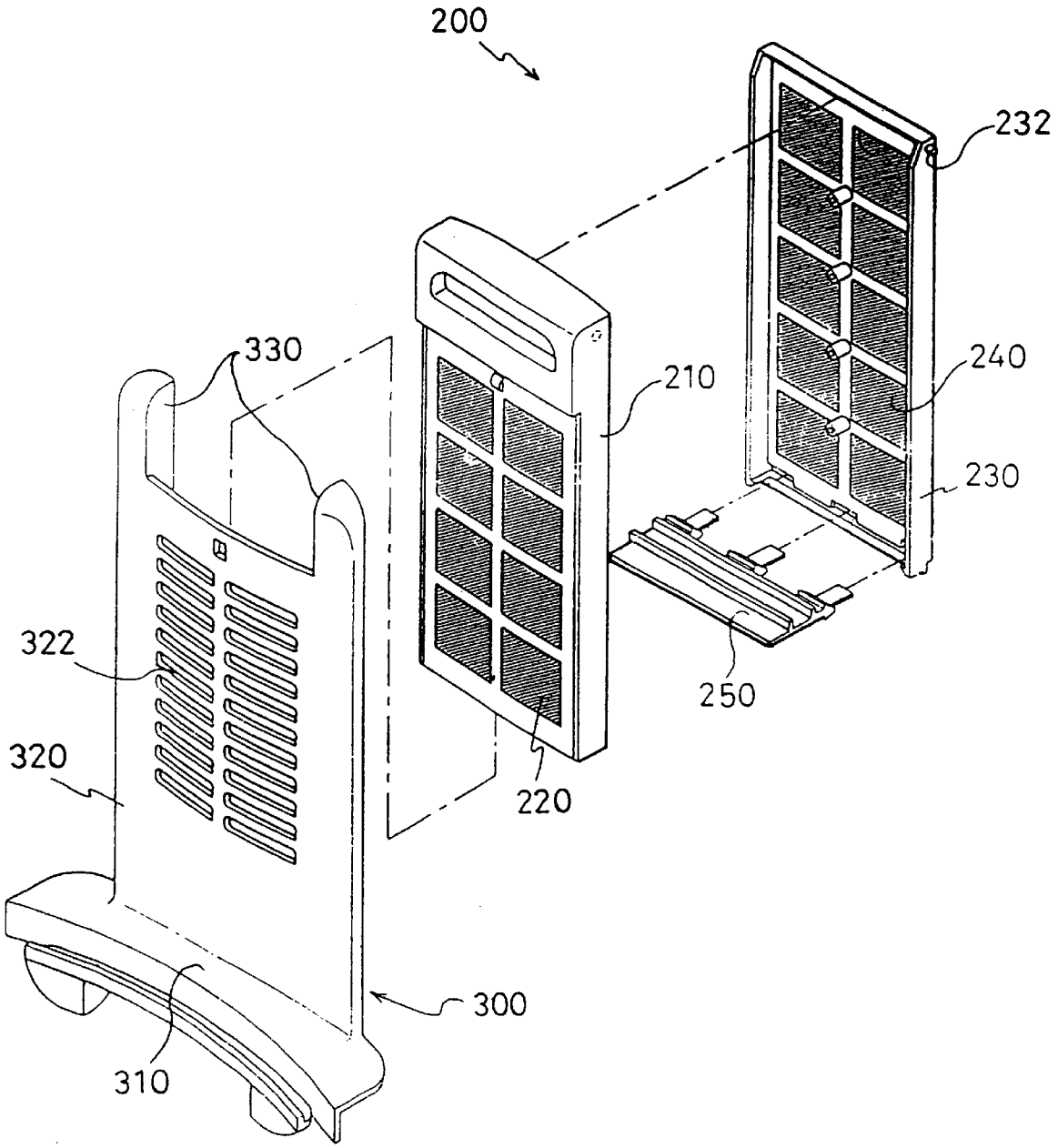
FIG. 3 (PRIOR ART)
FIG. 3 is an exploded perspective view of the filter shown in FIG. 2.
Figure 4A:
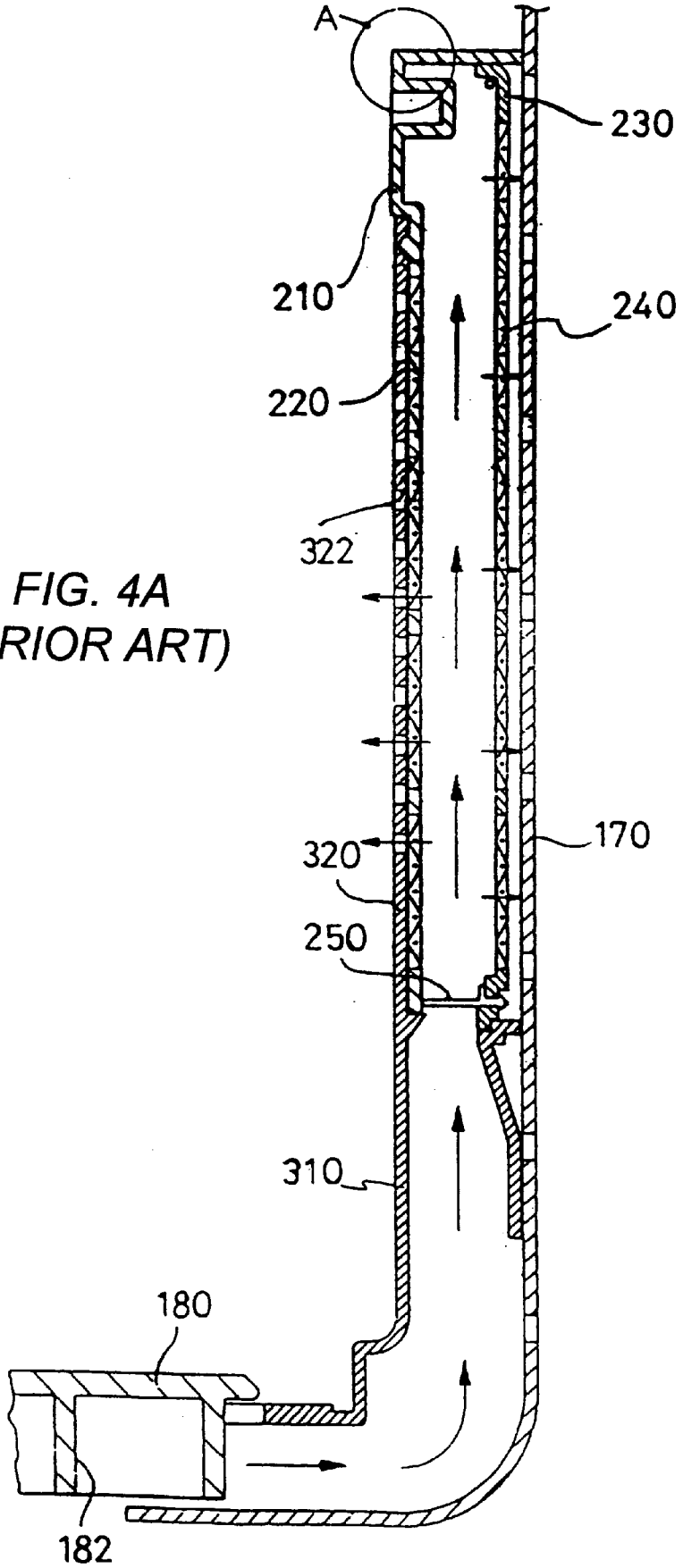
FIG. 4A (PRIOR ART)
FIG. 4A is a detailed sectional view showing the portion shown in FIG. 3 where the filter for a washing machine is mounted.
Figure 4B:
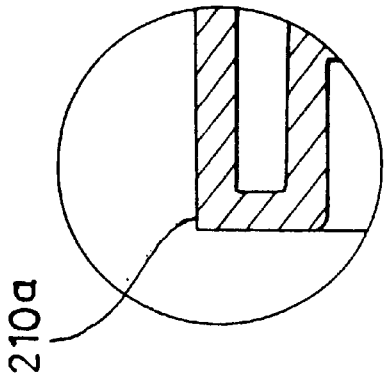
FIG. 4B (PRIOR ART)
FIG. 4B is an enlarged sectional view of the portion A in FIG. 4A.
Figure 7:
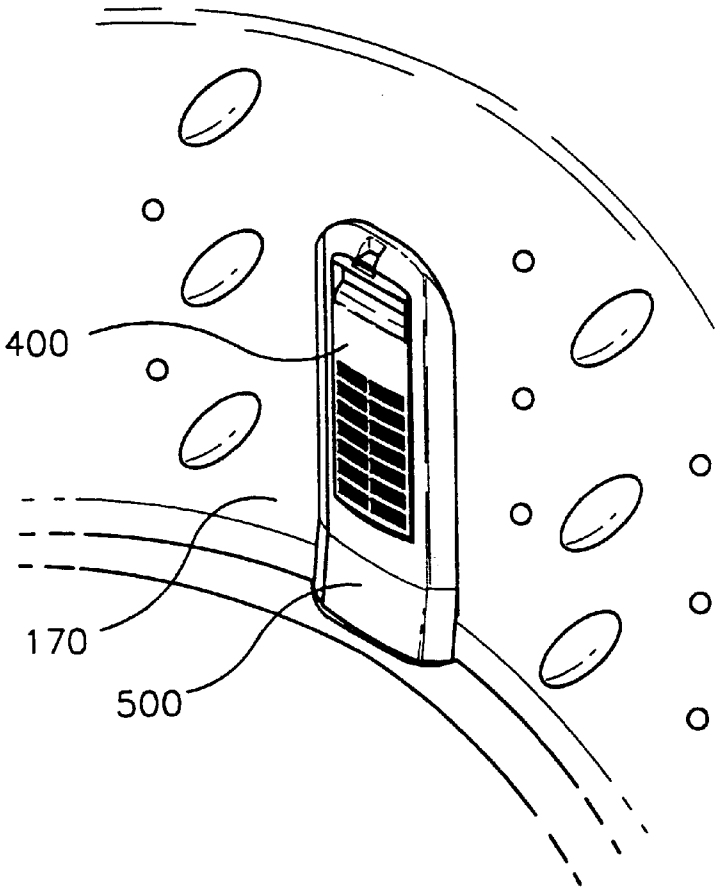
FIG. 7 is a exploded perspective view showing a state that the filter for a washing machine shown in FIG. 5 is mounted to the dehydrated tub.
Figure 5:
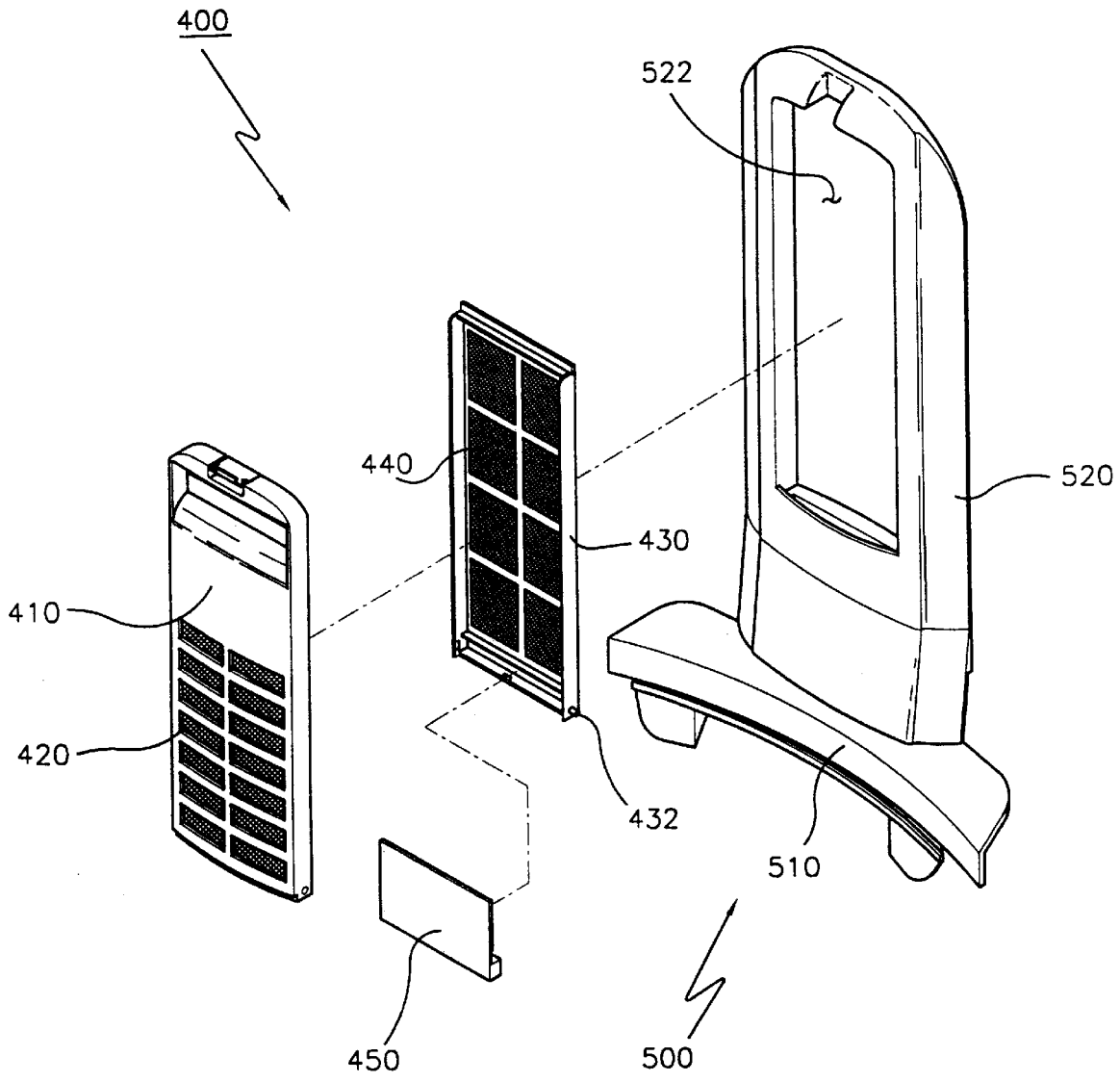
FIG. 5 is an exploded perspective view showing a filter for a washing machine according to the present invention.
Figure 6:
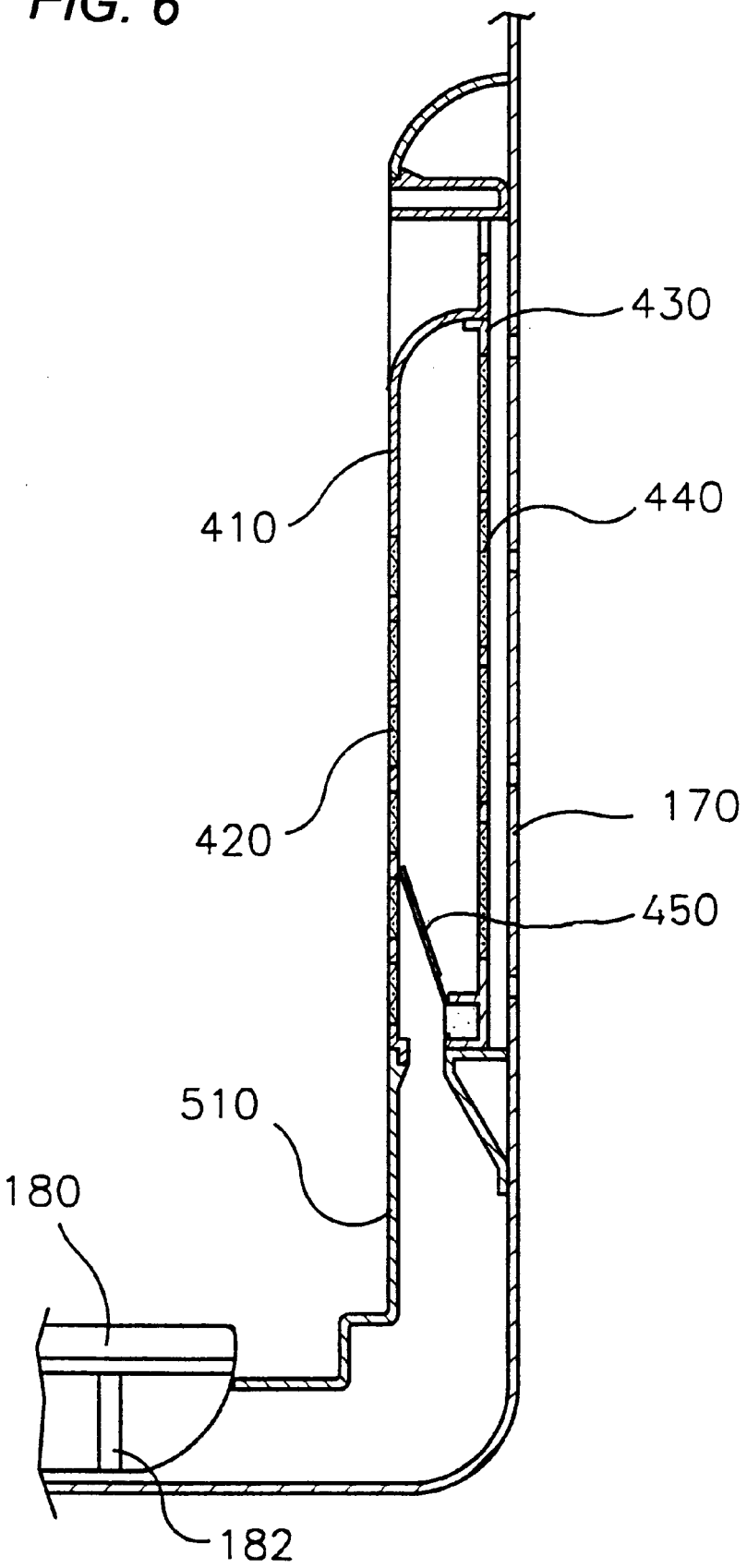
FIG. 6 is a sectional view showing a state that the filter for a washing machine according to the present invention attached to the inner lower portion of the dehydrating tub.

A filter according to a preferred embodiment of the present invention is shown in FIGS. 5 to 7.

As illustrated, a filter for a washing machine according to the present invention is attached to the inner lower portion of a dehydrating tub 170, which includes a filter case 500 and a pocket type filter 400 for filtering fluff by being inserted into filter case 500.

Filter case 500 includes an attachment portion 510 for attaching itself onto dehydrating tub 170, and a filter receiving portion 520 formed with an opening 522 into which pocket type filter 400 is inserted.

Pocket type filter 400 includes a front panel 410, a rear panel 430 and a check valve 450. Front panel 410 and rear panel 430 are coupled together to be opened/closed by a hinge shaft 432 formed to rear panel 430, and carry mesh nets 420 and 440 for filtering the fluff. Check valve 450 for opening/closing the space between front panel 410 and rear panel 430, is fixed to the lower side of rear panel 430 and made of a material such as a rubber.

Pocket type filter 400 as described above is accommodated within filter receiving portion 520 by being inserted into opening portion 522 of filter receiving portion 520 from preceding side of filter case 500.

When pocket type filter 400 is secured in filter receiving portion 520 of filter case 500, pocket type filter 400 and filter case 500 form a frontal shape such as a continuous curved shape.

Since the operation of the filter for a washing machine according to the present invention is same to the operation of the filter of the prior art, the description of the operation is abbreviated.

According to the present invention as described above, since pocket type filter 400 and filter case 500 form a continuous curved shape when pocket type filter 400 is secured in filter receiving portion 520 of filter case 500, the frontal shape prevents the laundry from damage during the washing or rinsing cycle.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A washing machine comprising a dehydrating tub for containing wash water, and a filter mounted on the tub for filtering wash water, the filter comprising:

a filter case including a lower attachment portion connected to a wall of the tub, and an upper filter-receiver portion; and a filter mounted in the filter-receiver portion and including:

a front panel facing an interior of the tub and carrying a filtering mesh, a rear panel hinged to the front panel and carrying a filtering mesh, a space formed between the front and rear panels and including a water inlet at a lower end thereof for admitting a flow of wash water to be passed through the filtering meshes of the front and a rear panels, and a check valve adjacent the water inlet of the space for preventing a backflow of wash water out of the space;

wherein a profile of an upper end of the filter case defines a smoothly curved continuation of an upper end of the front panel, to minimize damage to clothes being washed.

* * * * *